US011764457B2

(12) United States Patent
Zheng et al.

(10) Patent No.: US 11,764,457 B2
(45) Date of Patent: Sep. 19, 2023

(54) REFLECTIVE SURFACE ANTENNA BASED ON TRIPLE TELESCOPIC ROD DRIVE AND QUASI-GEODESIC GRID STRUCTURE

(71) Applicant: XIDIAN UNIVERSITY, Xi'an (CN)

(72) Inventors: Fei Zheng, Xi'an (CN); Lide Yan, Xi'an (CN); Mei Chen, Xi'an (CN); Xi Rui, Xi'an (CN)

(73) Assignee: XIDIAN UNIVERSITY, Xi'an (CN)

( * ) Notice: Subject to any disclaimer, the term of this patent is extended or adjusted under 35 U.S.C. 154(b) by 0 days.

(21) Appl. No.: 17/788,587

(22) PCT Filed: Jun. 9, 2021

(86) PCT No.: PCT/CN2021/099125
§ 371 (c)(1),
(2) Date: Jun. 23, 2022

(87) PCT Pub. No.: WO2022/105200
PCT Pub. Date: May 27, 2022

(65) Prior Publication Data

US 2023/0052062 A1 Feb. 16, 2023

(30) Foreign Application Priority Data

Nov. 23, 2020 (CN) ..... 202011322699.5

(51) Int. Cl.
*H01Q 1/12* (2006.01)
*H01Q 1/10* (2006.01)
(Continued)

(52) U.S. Cl.
CPC ..... *H01Q 1/125* (2013.01); *H01Q 1/10* (2013.01); *H01Q 15/16* (2013.01); *H01Q 19/18* (2013.01)

(58) Field of Classification Search
CPC ..... H01Q 1/12; H01Q 1/125; H01Q 1/10; H01Q 3/08; H01Q 15/14; H01Q 15/16; H01Q 19/18; H01Q 19/19
See application file for complete search history.

(56) References Cited

U.S. PATENT DOCUMENTS 3,714,660 A * 1/1973 Scrafford ..... H01Q 15/161 343/837
9,608,333 B1 3/2017 Toledo et al.

FOREIGN PATENT DOCUMENTS

CN 104682011 A * 6/2015 ..... H01Q 15/14
CN 105406167 A * 3/2016 ..... H01Q 1/12
(Continued)

OTHER PUBLICATIONS

Duan et al., "On Analysis and Optimization of an Active Cable-Mesh Main Reflector for a Giant Arecibo-Type Antenna Structural System" IEEE Transactions On Antennas And Propagation, vol. 55. No. 5, 2007, 8 Pages.

(Continued)

*Primary Examiner* — Hoang V Nguyen
(74) *Attorney, Agent, or Firm* — Workman Nydegger

(57) ABSTRACT

This invention proposes a reflective surface antenna based on a triple telescopic rod drive and quasi-geodesic grid structure, including a supportive back frame, a reflective surface frame, a vertical connecting rod, a primary reflective surface, an auxiliary reflective surface, a radial support rod, a feed source, and an attitude control device. The supportive back frame and reflective surface frame have a paraboloidal truss structure. The primary reflective surface is fixed on the quasi-geodesic grid of the reflective surface; the auxiliary reflective surface is fixed at the focal point of the primary reflective surface; the feed source is fixed at the apex of the reflective surface; and the attitude control device includes a base and a telescopic rod.

7 Claims, 2 Drawing Sheets

(51) Int. Cl.
*H01Q 15/16* (2006.01)
*H01Q 19/18* (2006.01)

(56) References Cited

FOREIGN PATENT DOCUMENTS

| | | | |
|---|---|---|---|
| CN | 106159458 | A | 11/2016 |
| CN | 106200684 | A | 12/2016 |
| CN | 207800919 | U | 8/2018 |
| CN | 209526211 | U | 10/2019 |
| CN | 112436292 | A | 3/2021 |

OTHER PUBLICATIONS

International Search Report and Written Opinion received for PCT Patent Application No. PCT/CN2021/099125, dated Sep. 7, 2021, 16 pages (3 pages of English Translation and 8 pages of Original Document).
Peng et al., "Electromechanical Coupling Optimization Design of Large Reflector Antennas with Truss Support Structures", Journal of Electronics & Information Technology, vol. 32, No. 1, 2010, 5 Pages.
International Preliminary Report on Patentability received for PCT Patent Application No. PCT/CN2021/099125, dated Jun. 1, 2023, 12 pages (8 pages of English Translation and 4 pages of Original Document).

* cited by examiner

REFLECTIVE SURFACE ANTENNA BASED ON TRIPLE TELESCOPIC ROD DRIVE AND QUASI-GEODESIC GRID STRUCTURE

CROSS-REFERENCE TO RELATED PATENT APPLICATION

This application is a 371 U.S. National Stage of PCT Application No. PCT/CN2021/099125, filed on Jun. 9, 2021, which claims the benefit of Chinese patent application No. CN202011322699.5, filed on Nov. 23, 2020, entitled "REFLECTIVE SURFACE ANTENNA BASED ON TRIPLE TELESCOPIC ROD DRIVE AND QUASI-GEODESIC GRID STRUCTURE." The entire content of each of the aforementioned patent applications is incorporated herein by reference.

TECHNICAL FIELD

The present invention belongs to the field of antenna technology and relates to a reflective surface antenna, specifically to a reflective surface antenna based on a triple telescopic rod drive and a quasi-geodesic grid structure.

BACKGROUND

A reflective surface antenna is a precision instrument that mainly receives electromagnetic radiation, and can also radiate electromagnetic waves outward, which can realize large aperture and narrow beam, with high resolution and high sensitivity, widely used in radio astronomy, radar, communication, and space exploration and other fields.

The traditional reflective surface antenna has a solid surface structure composed of rigid panels. In line with the development demand of communication applications, the antenna aperture becomes larger and larger. The severe deformation caused by the influence of self-weight, temperature, and wind load in the complex environment makes the antenna reflective surface precision poor, deviating from the demand surface shape, causing the antenna gain reduction, pointing deflection, auxiliary flap elevation, and other adverse effects, so it isn't easy to realize the wide application of large diameter antenna. To reduce the influence of environmental load, people have started to use the reflector antenna supported by a truss structure. Since the truss structure of the reflector antenna directly affects the weight of the overall antenna, it is necessary to conduct an in-depth study on the truss structure of the reflector antenna.

To provide a reflective surface antenna with a truss structure of high precision, lightweight, and easy installation, a reflective surface antenna with a double-layer ring truss mechanism has been disclosed in technology, including an inner ring truss, an outer ring truss, a plurality of inner and outer ring connecting trusses and a plurality of tie structures, and the four corresponding top corners between the inner ring truss and outer ring truss are supported by an inner and outer ring connecting truss. The defects of the above reflective surface antenna are that the complex truss structure leads to complicated processing and manufacturing, high weight, and the instability of the quadrilateral structure will affect the surface accuracy of the antenna; meanwhile, the processing and manufacturing of multiple types of truss structure are complex, and the molding process is too complicated. Because of the weight and manufacturing difficulty, it is more and more challenging to overcome the technical problem of expanding the aperture of the reflective surface, so it is not conducive to the further promotion of the use of a large aperture antenna.

SUMMARY

This invention proposes a reflective surface antenna based on a triple telescopic rod drive and a quasi-geodesic grid structure, including a supportive back frame, a reflective surface frame, a vertical connecting rod, a primary reflective surface, an auxiliary reflective surface, a radial support rod, a feed source, and an attitude control device.

The supportive back frame has a paraboloidal truss structure including a supportive primary back frame and a supportive secondary back frame. The supportive primary back frame has a truss structure formed by a plurality of first primary bars and a plurality of first primary joint balls connected and includes an inner ring frame, an outer ring frame, and a first number of radial frames distributed between the inner ring frame and the outer ring frame and evenly arranged in a radial pattern. The supportive secondary back frame includes a first number of truss structural units in the form of a quasi-geodesic grid. Each truss structural unit comprises a plurality of first secondary bars and a plurality of first secondary joint balls connected and distributed within a spatial area formed by an inner ring frame, an outer ring frame, and an adjacent radial frame in the supportive primary back frame. A first secondary rod in proximity to the first primary joint ball is connected to that first primary joint ball. The first number is greater than or equal to 6.

The reflective surface frame has a paraboloidal truss structure including a reflective surface primary frame and a reflective surface secondary frame. The reflective surface primary frame includes a plurality of second primary rods and a plurality of second primary joint balls, which are constructed and connected in the same manner as the supportive primary back frame. The reflective surface secondary frame includes a first number of truss structural units in the form of a quasi-geodesic grid. Each truss structural unit consists of a plurality of second secondary bars and a plurality of second secondary joint balls connected and distributed within the spatial area formed by the inner ring frame, the outer ring frame, and the adjacent radial frame in the reflective surface primary frame. The second secondary rods near the second primary joint ball are connected to that second primary joint ball.

Each first primary joint ball in the supportive primary back frame is connected to the second primary joint ball in the reflective surface primary frame at the corresponding position by a vertical connecting rod. Each first secondary joint ball in the supportive secondary back frame is connected to the second secondary joint ball in the reflective surface primary frame at the corresponding position by a vertical connecting rod.

The primary reflective surface includes a plurality of lightweight metal plates fixed to the quasi-geodesic grid of the reflective surface frame.

The auxiliary reflective surface has the shape of a paraboloidal with its opening surface opposite to the opening surface of the primary reflective surface and is fixed at the focal point of the primary reflective surface by a radial support rod.

The feed source is fixed at the apex position of the reflective surface frame.

The attitude control device includes a base and three telescopic rods, the bottom end of each telescopic rod is connected to the base through a corresponding rotating auxiliary connecting structure and the top end is connected to the supportive primary back frame through a corresponding spherical auxiliary connecting structure.

According to an embodiment, the first primary rod, the first secondary rod, the second primary rod, and the second secondary rod are composed of a hollow carbon fiber tube, a hollow aluminum alloy tube, or a hollow steel tube. The diameter of the first primary rod is larger than the diameter of the first secondary rod. The diameter of the second primary member is larger than the diameter of the second secondary rod. The diameter of the first primary rod is larger than the diameter of the second primary member. The diameter of the first secondary rod is larger than the diameter of the second secondary rod. The diameter of the first primary joint ball is larger than the diameter of the first secondary joint ball. The diameter of the second primary joint ball is larger than the diameter of the second secondary joint ball.

According to an embodiment, the lightweight metal plate of the primary reflective surface has a triangular or trapezoidal shape.

According to an embodiment, the focal distance of the auxiliary reflective surface and the primary reflective surface are equal. The focal axis of the auxiliary reflective surface coincides with the focal axis of the primary reflective surface.

According to an embodiment, the rotating auxiliary connecting structure has an equilateral triangular distribution of connection points with the base. The spherical auxiliary connecting structure has an equilateral triangular distribution of connection points with the supportive primary back frame.

According to an embodiment, the vertical connecting rod consists of a hollow carbon fiber tube, a hollow aluminum alloy tube, or a hollow steel tube.

According to an embodiment, the spherical auxiliary connecting structure has a composite ball hinge structure including a Hooke hinge and a rotation hinge.

To better describe and illustrate those embodiments and or examples of the invention disclosed herein, reference may be made to one or more of the accompanying drawings. The additional details or examples used to describe the accompanying drawings should not be considered as limiting the scope of any of the disclosed inventions, the currently described embodiments and/or examples, and the best mode of these inventions as currently understood.

DETAILED DESCRIPTION OF EMBODIMENT(S)

The invention is described in further detail below in conjunction with the accompanying drawings and specific embodiments.

Figure 1:
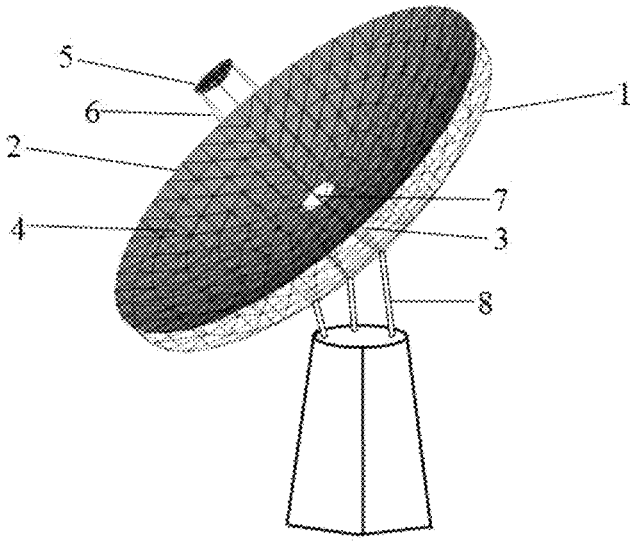
FIG. 1 is a perspective view of a reflective surface antenna according to the present invention.

FIG. 1 is a perspective view of a reflective surface antenna according to the present invention. The reflective surface antenna includes a supportive back frame 1, a reflective surface frame 2, a vertical connecting rod 3, a primary reflective surface 4, an auxiliary reflective surface 5, a radial support rod 6, a feed source 7, and an attitude control device 8. The primary reflective surface 4 includes a triangular-shaped lightweight metal plate.

Figure 2:
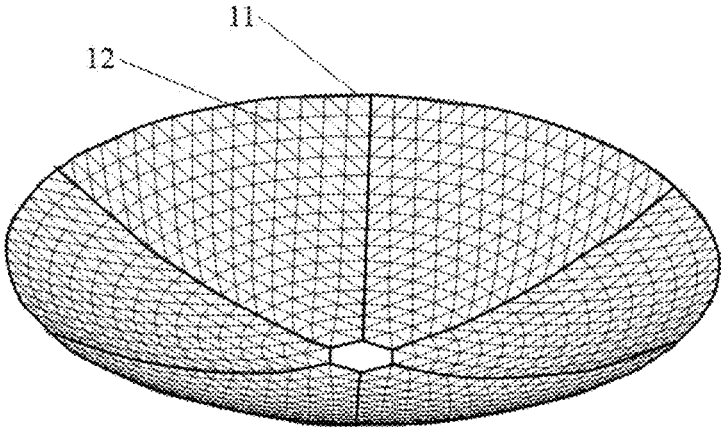
FIG. 2 is a perspective view of a supportive back frame according to the present invention.

FIG. 2 is a perspective view of a supportive back frame according to the present invention. The supportive back frame 1 has a parabolic truss structure including a supportive primary back frame 11 and a supportive secondary back frame 12. The supportive primary back frame 11 has a truss structure formed by a plurality of first primary rods and a plurality of first primary joint balls connected and includes an inner ring frame, an outer ring frame, and a first number of radial frames distributed between the inner ring frame and the outer ring frame and evenly arranged in a radial pattern. The supportive secondary back frame 12 includes a first number of truss structural units in the form of a quasi-geodesic grid. Each truss structural unit comprises a plurality of first secondary bars and a plurality of first secondary joint balls connected and distributed within the spatial area formed by the inner ring frame, the outer ring frame, and the adjacent radial frame in the supportive primary back frame 11. The first secondary rods near the first primary joint ball are connected to this first primary joint ball. The first number is greater than or equal to 6. Since the quasi-geodesic grid used in the truss structure unit in the supportive secondary back frame 12 has the characteristics of a single form and solid structure, it can effectively reduce the processing difficulty of the supportive back frame 1 and effectively reduce the quality of the antenna while ensuring the accuracy of the antenna shape surface.

Returning to FIG. 1, the reflective surface frame 2 has a paraboloidal truss structure including a reflective surface primary frame and a reflective surface secondary frame. The reflective surface primary frame includes a plurality of second primary rod and a plurality of second primary joint balls, which are constructed and connected in the same manner as the supportive primary back frame 11. The reflective surface secondary frame includes a first number of truss structural units in the form of a quasi-geodesic grid. Each truss structural unit consists of a plurality of second secondary bars and a plurality of second secondary joint balls connected and distributed within a spatial area formed by an inner ring frame, an outer ring frame and an adjacent radial frame in the reflective surface primary frame. The second secondary rods near the second primary joint ball are connected to this second primary joint ball. Since the quasi-geodesic grid used in the truss structure unit in the reflective surface secondary frame has the characteristics of a single form and solid structure, it can effectively reduce the processing difficulty of the reflective surface frame 2 and effectively reduce the quality of the antenna while ensuring the accuracy of the antenna shape surface.

The first primary bar, the first secondary bar, the second primary bar and the second secondary bar are composed of hollow steel tubes. The diameter of the first primary rod is larger than the diameter of the first secondary rod. The diameter of the second primary member is larger than the diameter of the second secondary rod. The diameter of the first primary rod is larger than the diameter of the second primary member. The diameter of the first secondary rod is larger than the diameter of the second secondary rod. The diameter of the first primary joint ball is larger than the diameter of the first secondary joint ball. The diameter of the second primary joint ball is larger than the diameter of the second secondary joint ball.

Each first primary joint ball in the supportive primary back frame 11 is connected to the second primary joint ball in the corresponding position in the reflective surface primary frame by a vertical connecting rod 3. Each first secondary joint ball in the supporting secondary back frame 12 is connected to the second secondary joint ball in the corresponding position in the reflective surface main frame by a vertical connecting rod 3. The vertical connecting rod 3 consists of a hollow steel tube.

The primary reflective surface 4 includes a plurality of triangular panels made of lightweight metal fixed to the quasi-geodesic grid of the reflective surface frame 2. The primary reflective surface 4 consists of a plurality of arrays stitched together in a circumferential direction with the vertices of the reflective surface frame 2 as the center of the circle. Each array includes a plurality of triangular panels. The number of arrays of the primary reflective surface 4 is the same as the number of equivalents in the circumferential direction of the primary reflective surface 4. Each array includes a plurality of radial layers. The number of radial layers in each array is the same as the number of radial fractional rings of the primary reflective surface 4. The number of triangular panels in the innermost radial layer in each array is three (3). The number of triangular panels added to each radial layer in each array is two (2) compared to the more inwardly adjacent radial layer up to the outermost radial layer.

The auxiliary reflective surface 5 has a paraboloidal shape with an open surface opposite to the open surface of the primary reflective surface 4 and is fixed at the focal position of the primary reflective surface 4 by a radial support rod 6. The focal distance of the auxiliary reflective surface 5 is equal to that of the primary reflective surface 4. The focal axis of the auxiliary reflective surface 5 coincides with the focal axis of the primary reflective surface 4.

The feed source 7 is fixed at the vertex position of the reflective surface frame 2.

Figure 3:
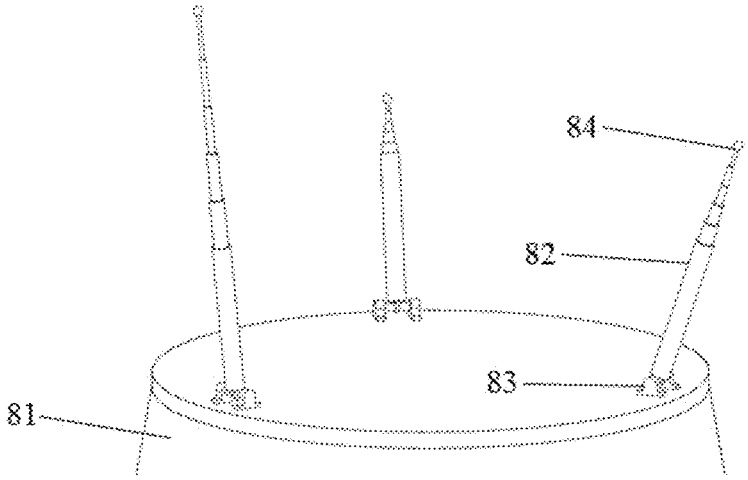
FIG. 3 is a perspective view of the posture control device according to the present invention.

FIG. 3 is a perspective view of an attitude control device according to the present invention. The attitude control device 8 includes a base 81 and three telescopic rods 82. The bottom end of each telescopic rod 82 is connected to the base 81 by a corresponding rotating auxiliary connecting structure 83, and the top end is connected to the supportive primary back frame 11 by a corresponding spherical auxiliary connecting structure 84. In order to meet the longer telescopic length, each telescopic rod 82 has a multi-segment combination connecting structure. The rotating auxiliary connecting structure 83 has an equilateral triangular distribution of connection points with the base 81. The spherical auxiliary connecting structure 84 has an equilateral triangular distribution of connection points with the supportive primary back frame 11. The attitude control device 8 quickly achieves attitude control of the reflective surface antenna in different workspaces in terms of orientation pitch, etc. by precisely adjusting the length of the three telescopic rod 82 and the rotation angle of the rotating auxiliary connecting structure 83. The spherical auxiliary connecting structure 84 has a composite ball hinge structure including a Hook hinge and a rotating hinge. The Hook hinge includes a left and right symmetrical U-shaped plate. The U-shaped plate is provided with threaded holes to secure the Hook hinge to the supportive primary back frame 11. The Hook hinge is connected to the U-shaped plate in the rotating hinge by a cross shaft. The bottom sleeve of the rotating hinge is connected to the upper ends of the three telescopic rod 82. The attitude control device 8 greatly simplifies the support structure for its tracking and positioning, resulting in a significant reduction in overall mass and flexibility of the entire reflective surface antenna structure system, as well as ease of maintenance and replacement.

In a second embodiment, the primary reflective surface 4 comprises a plurality of trapezoidal panels made of lightweight metal. The primary reflective surface 4 is formed by a plurality of arrays stitched together in a circumferential direction with the apex of the reflective surface frame 2 as the center of the circle. Each array includes a plurality of trapezoidal panels. The number of arrays of the primary reflective surface 4 is the same as the number of equivalents in the circumferential direction of the primary reflective surface 4. Each array includes a plurality of radial layers. The number of radial layers in each array is the same as the number of radial fractional rings of the primary reflective surface 4. The number of trapezoidal panels in each radial layer is 1, 2, or 4, depending on the maximum area of the trapezoidal panels. If the maximum area of the trapezoidal panel exceeds the area limit in the case where the number of trapezoidal panels in the radial layer is 1, the number of trapezoidal panels in the radial layer is changed to 2. If the maximum area of the trapezoidal panels exceeds the area limit when the number of trapezoidal panels in the radial layer is 2, the number of trapezoidal panels in the radial layer is changed to 4 until the outermost radial layer.

In the following, the technical effects of this invention are further described in conjunction with simulation experiments.

The reflective surface antenna of the above embodiment was simulated using the commercial simulation software.

In the simulation experiment, the aperture of the reflector system is set to 120 m, the focal diameter ratio is set to 0.4, the circumferential fraction of the reflective surface is set to 6, the number of radial fractional rings of the reflective surface is set to 15, the outer diameter of the hollow circular tube of the reflective surface primary frame is set to 0.137 m, the wall thickness of the hollow circular tube of the reflective surface primary frame is set to 0.030 m, the outer diameter of the hollow circular tube of the reflective surface secondary frame is set to 0.014 m, the wall thickness is set to 0.005 m, the outer diameter of the hollow circular tube of the supportive primary back frame is set to 0.196 m, the wall thickness of the hollow circular tube of the supportive primary back frame is set to 0.047 m, the outer diameter of the hollow circular tube of the supportive secondary back frame is set to 0.045 m, the wall thickness of the hollow circular tube of the supportive secondary back frame is set to 0.014 m, the outer diameter of the hollow circular tube of the vertical connecting rod is set to 0.125 m, and the wall thickness of the hollow circular tube of the vertical connecting rod is set to 0.125 m. All rigid bars were selected to be made of steel, the panel thickness of the reflective surface is set to 0.002 m, and the reflective surface is selected to be made of aluminum sheet metal.

The reflective surface antenna is placed in an elevated position and constrained to connect with the telescopic rod to three support points that are centrally symmetric. Under the action of gravity, the static equilibrium simulation of the reflective surface antenna is performed, and the results are shown in FIG. 4.

Figure 4:
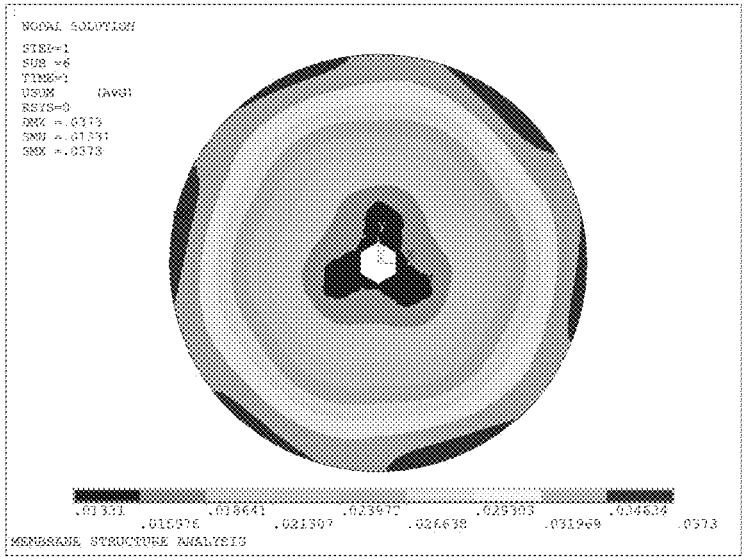
FIG. 4 is a graph of the static equilibrium simulation results of the reflective surface antenna according to the present invention.

From FIG. 4, the maximum deformation of the reflector system is 0.037 m. The surface density of the reflective surface is 104.20 kg/m$^2$, and the root mean square error of the node absolute position of the reflective surface is 28.08 mm Based on this, the shape conformal design is further developed, and the shape accuracy is 0.82 mm Compared with the reflective surface with a surface density of 407 kg/m$^2$ and a profile accuracy of 1.0 mm in the references, it can be seen that the reflective surface antenna of this invention can effectively reduce the mass of the antenna while ensuring the antenna profile accuracy.

Since the supportive secondary back frame and reflective surface secondary back frame both have the truss structure in the form of quasi-geodesic grid, the reflective surface antenna of the present invention has the characteristics of single form, solid structure and symmetrical structure compared with the conventional technology. The reflective surface antenna of this invention can effectively reduce the quality of the antenna while ensuring the accuracy of the antenna shape surface.

The reflective surface antenna of this invention realizes attitude control of the reflecting device with the help of the parallel drive structure of three telescopic rod, which greatly simplifies the support structure for its tracking and positioning. Due to the high institutional stiffness of the reflective surface antenna, non-accumulation of position errors, simple and convenient control, easy manufacturing and low price, the overall mass of the whole reflective surface antenna structure system is significantly reduced, flexibility is significantly improved, and it is easy to maintain and replace.

The primary reflective surface of the reflective surface antenna of this invention has a center-symmetric structure made of multiple lightweight metal plates spliced together, with a simple structure layout rule, which is easy to manufacture and maintain.

The attitude control device of the reflective surface antenna of this invention connects the three telescopic rods with the supportive primary back frame by means of a spherical auxiliary connecting structure, so it can successfully solve the problem of discontinuity of the conventional pitch-azimuth tracker when it passes through the "blind cone" airspace of the zenith. The reflective surface antenna of this invention can easily and quickly achieve attitude control in different working spaces such as azimuth pitch.

The specific embodiments described above are illustrative of the present invention and do not constitute a limitation of the present invention. Apparently, a person skilled in the art can make various modifications or additions to the specific embodiments described or substitute them in a similar manner, but they do not deviate from the spirit of this invention or go beyond the scope defined in the appended claims. For example, this example uses the terms telescopic rod, reflective surface frame, supportive back frame, vertical connecting rod, etc., but does not exclude the possibility of using other terms. These terms are used to more easily describe and explain the essence of the present invention, and it would be contrary to the spirit of the present invention to interpret them as any kind of additional limitation. Such various modifications and changes in form or details without departing from the principle and structure of this invention are still within the scope of protection of the claims of this invention.

The invention claimed is:

1. A reflective surface antenna based on a triple telescopic rod drive and a quasi-geodesic grid structure, comprising a supportive back frame, a reflective surface frame, a vertical connecting rod, a primary reflective surface, an auxiliary reflective surface, a radial support rod, a feed source, and an attitude control device, wherein the supportive back frame has a parabolic truss structure comprising a supportive primary back frame and a supportive secondary back frame, the supportive primary back frame having a truss structure formed by a plurality of first primary bars and a plurality of first main joint balls connected and comprising an inner ring frame, an outer ring frame and a first number of radial frames distributed between the inner ring frame and the outer ring frame and evenly arranged in a radial pattern, said supportive secondary back frame comprises a first number of truss structural units in the form of a quasi-geodesic grid, each truss structural unit comprising a plurality of first secondary rods and a plurality of first secondary joint balls connected and distributed in a space area formed by the inner ring frame, the outer ring frame and the adjacent radial frame in the supportive secondary back frame, the first secondary rod adjacent to the first primary joint ball being connected to said first primary joint ball, the first number being greater than or equal to 6;

the reflective surface frame has a paraboloidal truss structure comprising a reflective surface primary frame and a reflective surface secondary frame, the reflective surface primary frame comprising a plurality of second primary rods and a plurality of second primary joint balls in the same structure and connection as the supportive primary back frame; the reflective surface secondary frame comprises a first number of truss structural units in the form of a quasi-geodesic grid, each truss structural unit comprising a plurality of second secondary rods and a plurality of second secondary joint balls connected and distributed in the spatial area formed by the inner ring frame, the outer ring frame and the adjacent radial frame in the reflective surface primary frame, the second secondary bars near the second primary joint balls being connected to said second primary joint balls;

each first primary joint ball in the supportive primary back frame is connected to the second primary joint ball in the reflective surface primary frame at the corresponding position by a vertical connecting rod, and each first secondary joint ball in the supportive secondary back frame is connected to the second secondary joint ball in the reflective surface primary frame at the corresponding position by a vertical connecting rod;

the primary reflective surface comprises a plurality of lightweight metal plates fixed to the quasi-geodesic grid of the reflective surface frame;

the auxiliary reflective surface has the shape of a paraboloidal with its opening surface opposite the opening surface of the primary reflective surface and is fixed at the focal point of the primary reflective surface by means of a radial support rod;

the feed source is fixed at the vertex position of the reflective surface frame;

the attitude control device includes a base and three telescopic rods, each telescopic rod is connected to the base by a corresponding rotating auxiliary connecting structure at the bottom end and to the supportive primary back frame by a corresponding spherical auxiliary connecting structure at the top end.

2. The reflective surface antenna based on a triple telescopic rod drive and a quasi-geodesic grid structure according to claim 1, wherein:

the first primary rod, the first secondary rod, the second primary rod and the second secondary rod are composed of a hollow carbon fiber tube, a hollow aluminum alloy tube or a hollow steel tube, the diameter of the first primary rod is larger than the diameter of the first secondary rod, the diameter of the second primary rod is larger than the diameter of the second secondary rod, the diameter of the first primary rod is larger than the diameter of the second primary rod, the diameter of the first secondary rod is larger than the diameter of the second secondary rod, the diameter of the first primary joint ball is greater than the diameter of the first secondary joint ball, and the diameter of the second primary joint ball is greater than the diameter of the second secondary joint ball.

3. The reflective surface antenna based on a triple telescopic rod drive and a quasi-geodesic grid structure according to claim 1, wherein the lightweight metal plate of the primary reflective surface has a triangular or trapezoidal shape.

4. The reflective surface antenna based on a triple telescopic rod drive and a quasi-geodesic grid structure according to claim 1, wherein:

the focal distance of the auxiliary reflective surface is equal to that of the primary reflective surface, and the focal axis of the auxiliary reflective surface coincides with the focal axis of the primary reflective surface.

5. The reflective surface antenna based on a triple telescopic rod drive and a quasi-geodesic grid structure according to claim 1, wherein:

the rotating auxiliary connecting structure has an equilateral triangular distribution of connection points with the base, and the spherical auxiliary connecting structure has an equilateral triangular distribution of connection points with the supportive primary back frame.

6. The reflective surface antenna based on a triple telescopic rod drive and a quasi-geodesic grid structure according to claim 1, wherein the vertical connecting rod is composed of a hollow carbon fiber tube, a hollow aluminum alloy tube, or a hollow steel tube.

7. The reflective surface antenna based on a triple telescopic rod drive and a quasi-geodesic grid structure according to claim 1, wherein the spherical auxiliary connecting structure has a composite spherical hinge structure comprising a Hook hinge and a rotating hinge.

* * * * *